United States Patent [19]

Reid

[11] 4,452,535

[45] Jun. 5, 1984

[54] CONCRETE PRODUCTION APPARATUS

[76] Inventor: Samuel I. Reid, 210 Admiral Cir., Laurenceburg, Laurence Co., Tenn. 38464

[21] Appl. No.: 377,870

[22] Filed: May 13, 1982 (Under 37 CFR 1.47)

[51] Int. Cl.[3] ..... B01F 15/06

[52] U.S. Cl. ..... 366/22; 366/40; 366/142; 366/148; 62/324.1; 62/324.3

[58] Field of Search ..... 62/324.1, 324.3, 129, 62/238, 164; 366/7, 22, 23, 40, 142, 144, 145, 148

[56] References Cited

U.S. PATENT DOCUMENTS 2,182,788 12/1939 Cornell, Jr. ..... 62/165

2,751,761 6/1956 Borgerd ..... 62/129

4,194,368 3/1980 Bahel et al. ..... 62/238

*Primary Examiner*—Robert W. Jenkins

*Assistant Examiner*—Arthur D. Dahlberg

*Attorney, Agent, or Firm*—James C. Kesterson

[57] ABSTRACT

A concrete production apparatus produces concrete within a selected temperature range. Ground water is circulated through a heat exchanger in the apparatus to provide a heat source or a heat dump. Concrete water is circulated through another heat exchanger and is heated or cooled to a predetermined temperature. The concrete water at the predetermined temperature is mixed with cement and aggregate to produce a concrete mix within the selected temperature range.

10 Claims, 3 Drawing Figures

CONCRETE PRODUCTION APPARATUS

The present invention relates to concrete producing apparatus and particularly relates to a concrete producing apparatus that uses ground water as a heat source or heat dump to produce a concrete mix in a selected temperature range.

For most applications, concrete mix must be produced within a selected temperature range so that it will cure properly and have the desired strength and hardness characteristics. Construction contracts will require that the mixed concrete be produced within a temperature range of 53° F. to 90° F. Producing concrete within such temperature range can be a significant problem in terms of the expense of producing the concrete. In the winter, the concrete mix must be heated and in the summer, the concrete mix must be cooled. As the temperature changes, the heating and cooling requirements change accordingly.

A concrete mix usually includes cement, aggregate and water. To produce the concrete within a selected temperature range, it would be possible to heat any one or all of the components of the concrete mix, but it is usually preferred to heat or cool the concrete water. Typical methods of heating concrete water include the use of an electric blower, a fuel oil heater, or a gas heater. Methods for cooling concrete water include the use of block ice, an ice flaker, or liquid nitrogen.

The problem with the typical methods of heating and cooling a concrete mix is basically expense. For example, in 1981, cooling costs in producing concrete could be estimated to be $1.78 per cubic yard using block ice, 0.096 per cubic yard using an ice flaker and $4.00–$6.00 per cubic yard using liquid nitrogen. The cost for heating a cubic yard of concrete mix could be estimated as 0.26 dollars using an electric blower, 0.22 dollars using a fuel oil heater and 0.26 using LP gas.

Other problems, such as inconvenience, inflexibility, lack of reliability, and inaccuracy are also associated with typical conventional heating and cooling systems for concrete mix. Also, in most concrete mix heating and cooling systems, it is necessary to provide two entirely separate systems, one to heat and one to cool the concrete mix.

The foregoing and other problems associated with concrete production are solved by the present invention in which a single concrete production apparatus produces concrete within a selected temperature range and is operable to either heat or cool the concrete water. The apparatus includes a well drilled into the earth to a ground water table. A pump operates to pump ground water from the well for use in the apparatus, and a heat exchange system is connected to receive and circulate the ground water. A water circulation system also cicu-lates concrete water through the heat exchange system to exchange heat between the concrete water and the ground water. In a heating mode, the heat exchanger system is operable to remove heat from the ground water and transfer it to the concrete water, and in the cooling mode, heat is removed from the concrete water and is transferred to the ground water. In such manner, the concrete water in the water circulation system is temperature conditioned to a predetermined temperature which is selected to mix with and bring the temperature of the aggregate and cement to within the selected temperature range. A concrete mixer receives the concrete water at the predetermined temperature and mixes it with cement and aggregate to produce a concrete mix within the selected temperature range.

The heat exchanger system may include first and second heat exchangers connected to receive and circulate water from the pump and to receive and circulate a heat transfer fluid. In this embodiment, a compressor is provided to produce pressurized fluid at its output and to receive at its input depressurized fluid relative to the pressurized fluid. First compressor piping interconnects the output of the compressor with at least one of the heat exchangers for transmitting pressurized fluid to and circulating it through the heat exchanger, and an expansion valve system interconnects the two heat exchangers for transmitting fluid therebetween and for expanding (depressurizing) the pressurized fluid as it flows from one heat exchanger to the other. The depressurized fluid is circulated through the other heat exchanger, and second piping interconnects the input of the compressor with the other heat exchanger for transmitting the depressurized fluid to the input of the compressor. The water circulated through both heat exchangers is in thermal contact with the heat transfer fluid. The heat exchanger receiving pressurized fluid heats the water while the exchanger with depressurized fluid cools the water.

The water circulation system may include, in one embodiment, ground water piping connected to the pump for transmitting ground water to one of the heat exchangers. After the ground water has been circulated through the heat exchanger, structure, such as an injection well, is provided for discharging ground water. Ground water piping is also provided for transmitting ground water from the pump to an on/off valve and, another set of piping is connected to transmit the ground water from the on/off valve to the other heat exchanger where the ground water is temperature conditioned to produce concrete water. A first concrete water pipe transmits the concrete water from the first heat exchanger to a first tank valve that selectively transmits concrete water to at least one storage tank.

Second concrete water piping extends from the storage tank to a second tank valve that selectively transmits concrete water from the tank to a second pump. The second pump is operable to pump concrete water from the tank through the second tank valve to a third tank valve that selectively transmits the concrete water either to a return pipe connected to transmit the concrete water back to to the input of the other heat exchanger for recirculating the concrete water therethrough or that transmits concrete water to a concrete mixer for mixing the water with the cement and aggregate. Thus, the water circulation system of this embodiment is operable to circulate water through a heat exchanger, store it after the water has been either heated or cooled, and then transmit the water to a concrete mixer or recirculate the water through the heat exchanger.

The present invention may best be understood by reference to the following detailed description of an embodiment of the invention when considered in conjunction with the drawings in which.

Figure 1:
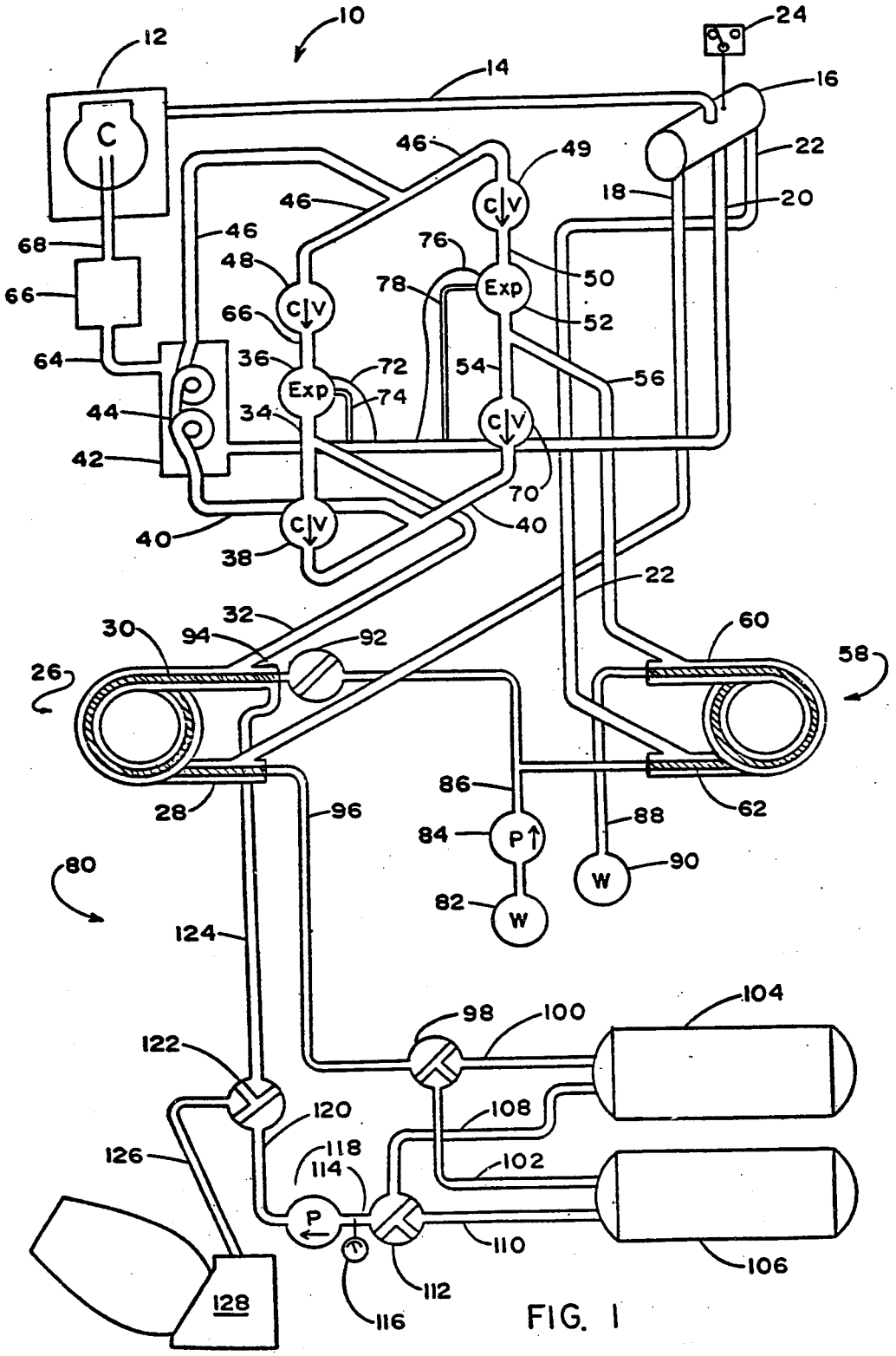
FIG. 1 is a somewhat diagrammatical schematic view of a concrete production apparatus embodying the present invention.

Referring now to the drawings in which like references characters designate like or corresponding parts throughout the several views, there is shown in FIG. 1 a somewhat diagrammatical schematic view of a concrete production apparatus 10 embodying the present invention. The apparatus 10 includes a compressor 12 such as manufactured by Schnacke-Grasso, Inc., (Model F or E) for compressing heat transfer fluid, or refrigeration fluid, such as freon. The compressor 12 outputs pressurized heat transfer fluid through pipe 14 which extends from the compressor 12 to a four-way valve 16. Three other pipes 18, 20 and 22 are interconnected with the four-way valve 16 so that the heat transfer fluid from pipe 14 may be transmitted to either pipe 18 or pipe 22.

A switch 24 is connected to control the four-way valve 16 and will switch the valve between a heating position and a cooling position. When valve 16 is in a heating position, the valve transmits fluid from pipe 14 to pipe 18 and from pipe 22 to pipe 20. When valve 16 is in the cooling position, it transfers fluid from pipe 14 to pipe 22 and from pipe 18 to pipe 20.

Assuming valve 16 is in the heating position, pressurized fluid is transmitted from the valve through pipe 18 to a coiled heat exchanger 26 which is a double-walled tubular coil pipe heat exchanger manufactured by Turbotech. The heat exchanger 26 includes an exterior flow path 28 and an interior flow path 30. In the heating mode, pressurized heat transfer fluid is circulated through the exterior flow path 28 and water is circulated through the interior flow path 30.

After the heat transfer fluid is circulated through the heat exchanger 26, it is output through pipe 32 to pipe 34 which extends between the output of an expansion valve 36 and the input of a check valve 38. Thus, pressurized fluid flows from the pipe 32 through pipe 34 and through check valve 38 into piping 40. Check valve 38 and all check valves mentioned herein are convention check valves such as manufactured by Superior Valve Co. and are operable to allow fluid flow through the valve in the direction indicated by an arrow on the valve symbol in FIG. 1. Check valve 38 will allow fluid to flow from the pipe 34 to piping 40, but it will not allow fluid flow in the reverse direction.

The pressurized fluid in piping 40 is transferred into a receiving tank 42 which has a heat transfer coils 44 disposed therein. The pressurized fluid is transmitted through the coils 44 to heat the depressurized fluid within the tank 42 as will be hereinafter described in greater detail. Pressurized fluid leaves the tank 42 through piping 46 which is interconnected with the inputs of check valves 48 and 49. Since the pressure in pipe 34 is slightly greater than the pressure in pipe 46, the pressurized fluid will flow from piping 46 through check valve 49 and into pipe 50. The pressurized fluid in pipe 50 is transmitted to the input of an expansion valve 52 where the fluid is expanded and released into pipe 54. Due to the expansion, the fluid in the pipe 54 is depressurized and has dropped in temperature so that it is cold relative to the pressurized fluid in pipe 50.

The depressurized fluid is transmitted through pipe 56 to a double-walled tubular coil heat exchanger 58 having an interior flow path 62 and an exterior flow path 60. The depressurized heat transfer fluid is circulated through the exterior flow path 60, and water having a greater temperature than the fluid in the exterior flow path 60 is circulated in the interior flow path 62. Thus, the heat transfer fluid in the exterior flow path 60 absorbs heat from the water, and the fluid is transmitted by pipe 22 back to the four-way valve 16.

The four-way valve 16 interconnects pipe 22 with pipe 20 and the depressurized fluid is transmitted by pipe 20 to the receiving tank 42. As previously mentioned, pressurized fluid is flowing in the coils 44 within the tank 42 so that the relatively cool depressurized fluid in the tank 42 is heated by coils 44. Then the heated depressurized fluid from tank 42 is transmitted through pipe 64 to a suction line accumulator tank 66 and from the tank 66 the fluid travels through a pipe 68 to the input of the compressor 12.

As described above, the apparatus 10 performs a heating function. That is, the water in the interior flow path 30 of heat exchanger 26 is heated by the pressurized fluid flowing in the exterior flow path 28. Then, the heat transfer fluid is depressurized and circulated through the exterior flow path 60 of heat exchanger 58 and heat is absorbed from the water flowing in the interior flow path 62 by the heat transfer fluid. Thus, in the heating mode, water in the interior flow path 30 is heated and water in the other interior flow path 62 is cooled.

To function in the cooling mode, the fluid flow in the apparatus 10 is somewhat reversed. The heat transfer fluid is transmitted from pipe 14 through the four-way valve 16 to pipe 22 and depressurized fluid from pipe 18 is transmitted to pipe 20. The pressurized fluid in pipe 22 is relatively hot and is transmitted to the exterior flow path 60 of the heat exchanger 58. The fluid in flow path 60 heats the water in the interior flow path 62 and, thus, the fluid of the exterior flow path is cooled. The cooled pressurized fluid from exterior flow path 60 is transmitted through pipe 56 and pipe 54 to the input of another check valve 70 which, again, is convention in design and is operable to transmit fluid in the direction indicated by the arrow on check valve 70 in FIG. 1. Valve 70 transmits fluid from pipe 54 to piping 40 and the fluid is then transmitted therefrom through the coils 44 in the receiving tank 42 into piping 46.

Since the pressure in piping 46 is slightly less than the pressure in pipe 54, the fluid will not be transmitted through check valve 49, but will be transmitted through check valve 48 to a pipe 66. The pipe 66 transmits the pressurized fluid to an expansion valve 36 which is identical to the expansion valve 52. This valve 36 expands or depressurizes the fluid from line 66 and produces depressurized, relatively cold, fluid in pipe 34. The cold depressurized fluid is transmitted from pipe 34 through pipe 32 to the exterior flow path 28 of the heat exchanger 26. In the heat exchanger 26, the relatively cold heat transfer fluid absorbs heat from water flowing in the interior flow path 30 and, thus, cools the water in the flow path 30. After circulating through the heat exchanger 26, the depressurized heat transfer fluid is transmitted through pipe 18, through the four-way valve 16, and through pipe 20 to the receiving tank 42, again, the depressurized fluid entering the receiving tank 42 is heated by the coils 44 and exits the tank 42 through pipe 64. The pipe 64 transmits the heated depressurized fluid from the receiving tank 42 to the suction line accumulator tank 66, and the fluid is transmitted from tank 66 through pipe 68 back to the input of compressor 12.

In either the heating or the cooling mode, the expansion valves 36 and 52 constantly monitor the temperature and pressure of the heat transfer fluid in the pipe 20. The expansion valves 36 and 52 are manufactured by Alco Controlls, Division of Emerson Electric Co. and include temperature and pressure sensors that are operable to regulate the expansion characteristics of the valves. The sensors within the expansion valve 36 are connected with the interior of pipe 22 by a temperature probe wire 72 and a pressure tube 74, and likewise, expansion valve 52 is interconnected with the interior of pipe 20 by temperature probe wire 76 and pressure tube 78. If the temperature and pressure within pipe 20 fall below selected values, the expansion valves 36 and 38 will move toward opening to create a smaller pressure/-temperature differential between the pressurized fluid and the depressurized fluid. If the temperature and pressure of the fluid in pipe 20 exceeds a predetermined value, the expansion valves 36 and 52 will move toward closing to increase the pressure/temperature differential between the pressurized fluid and the depressurized fluid.

In the discussion above, the heating and cooling mechanism of the concrete production apparatus 10 has been described whose function is to heat or cool concrete water. A water circulation system 80 which is generally schematically shown in the lower portion of FIG. 1 is provided to circulate concrete water through heat exchanger 26 and ground water through heat exchanger 58. The water circulation system 80 includes a well 82 that is drilled to ground water level, and a pump 84 for pumping ground water from the well 82 for use in the apparatus 10. Ground water is transmitted from the pump 84 by piping 86 to an input of the heat exchanger 58. The ground water from piping 86 is circulated through the interior flow path 62 of the heat exchanger 58 and is returned by a pipe 88 to another well 90 where the ground water is injected into the ground water table. In another embodiment, instead of using the injection well 90, the ground water in pipe 88 may be discharged into a holding tank or pond, or is otherwise disposed of.

The function of heat exchanger 58 is to provide a heat source or a heat dump for the apparatus 10. In the cooling mode, heat is transferred to the ground water in the exchanger 58 by the heat transfer fluid and the heated ground water is then discharged. In the heating mode, heat is absorbed from the ground water in exchanger 58 by the heat transfer fluid, and the cooled ground water is discharged.

Referring again to pump 84, the piping 86 also transmits ground water from pump 84 to a valve 92. Valve 92 is an on/off water valve for selectively shutting off the ground water supply from well 82. The ground water from valve 92 is transmitted through a pipe 94 to the input of heat exchanger 26 and is circulated through the interior flow path 30 thereof. In the heating mode, the ground water from pipe 94 is heated, and in the cooling mode the ground water is cooled by the heat transfer of fluid circulating in the exterior flow path 28.

When the ground water has been circulated through the interior flow path 30, it is has been temperature conditioned to a desired temperature, and the water at the output of the heat exchanger 26 is referred to herein as concrete water because of such conditioning. The concrete water is transmitted through pipe 96 to a three-way valve 98. Valve 98 is operable to block the flow of concrete water from pipe 96, or to transmit the concrete water to one or both of pipes 100 and 102 to selectively fill one or both of tanks 104 and 106 with concrete water. The tanks 104 or 106 are large insulated storage tanks used to store the concrete water until it is mixed with the cement and aggregate or until it is recirculated to the heat exchanger 26. The concrete water from tanks 104 and 106 may be transmitted, respectively, through pipes 108 and 110 to a valve 112. Valve 112 is operable to block the flow of concrete water from pipe 108 and 110 or transmit the water from either one or both of such pipes to a pipe 114 at the output of valve 112. The pipe 114 is connected to a pump 118 that is operable to selectively pump concrete water from tank 104 or 106 according to the position of valve 112. Also, a temperature gauge 116 is mounted to detect the temperature of water in the pipe 114 to insure that the temperature of the concrete water is within a selected range or is at an appropriate predetermined temperature such as 35° in the cooling code or 120° in the heating mode.

The pump 118 pumps concrete water through a pipe 120 to another three-way valve 122 that is operable to block the concrete water from pipe 120 or to transmit it to one or both of the pipes 124 and 126. Pipe 124 is interconnected with pipe 94 and may be designated as a return pipe since it returns concrete water to the input of the heat exchanger 26 and recirculates the concrete water through the heat exchanger. Thus, the concrete water may be temperature conditioned a second time or more in order to bring the concrete water to the desired predetermined temperature.

The second output of the three-way valve 122 transmits concrete water through pipe 126 to a concrete mixer 128 wherein the concrete water is mixed with aggregate and cement to produce a concrete mix or concrete.

It will be understood that the three-way valves 98, 112 and 122 may be replaced by two on/off valves and a T pipe. For example, valve 98 could be replaced with a T pipe so that concrete water is continually transmitted from pipe 96 to pipe 100 and 102. However, an on/off valve would be installed after the T pipe on both pipe 100 and 102 so that water could be transmitted to either one or both of the pipes 104 and 106 by adjusting the two on/off valves.

In the water circulation system 80, a high degree of flexibility is achieved. In the simplest mode of operation, water is simply pumped from well 82, circulated through the heat exchanger 26 and is pumped into one of the tanks 104 or 106 for later use. When it is desired to mix concrete, concrete water is pumped from one or both of the tanks 104 and 106 to the mixer 128. However, if desired, the concrete water maybe recirculated through the heat exchanger 26 using one or both tanks. For example, assuming tank 106 has been previously filled with concrete water and that tank 104 is empty, valve 98 may be set to fill only tank 104 and valve 112 and 122 may be set to pump concrete water only from tank 106 through pipe 124 and back through the heat exchanger 26. In this mode of operation, valve 92 would be turned off to block the flow of water from the well 82. Thus, the water from tank 106 will be recirculated through the heat exchanger 26 and pumped back into the tank 104. By simply adjusting valves 98 and 112, it would also be possible to circulate water from tank 104 through the exchanger 26 and back to tank 106 or to circulate water from and back into the same tank.

Figure 2:
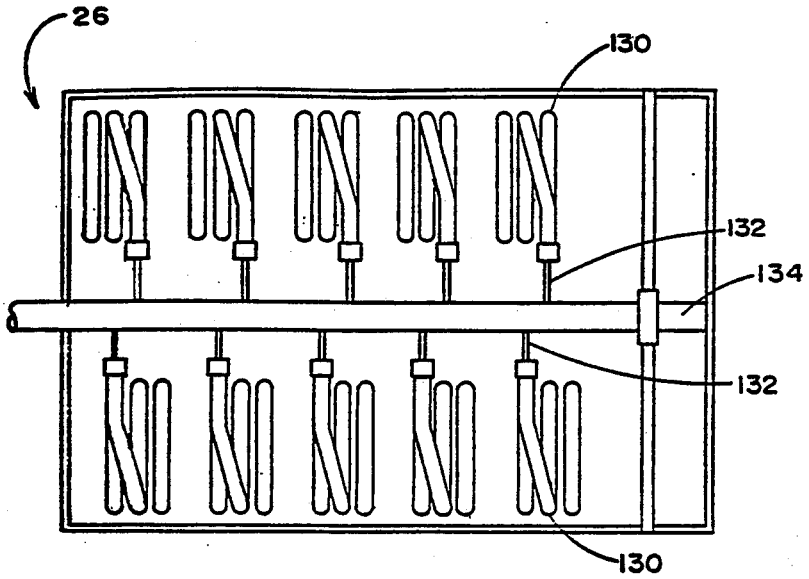
FIG. 2 is a top view of a heat exchanger used in the concrete production apparatus of the present invention.

Referring now to FIG. 2 there is shown a top view of the heat exchanger 26 that was schematically shown in FIG. 1. It will be appreciated that the heat exchanger 26 is in actuality a plurality of double-walled tubular coils 130 through which water and heat transfer fluid are circulated. In the top view of FIG. 2, it is shown that each of the coils 130 is connected to a top manifold 134.

Figure 3:
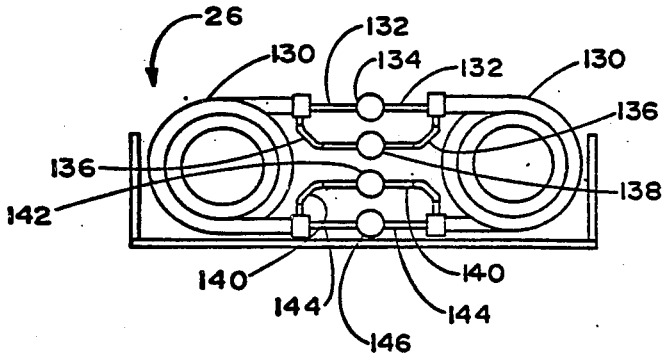
FIG. 3 is a side view of the heat exchanger.

Referring now to FIG. 3, there is shown a side view of the heat exchanger 26 of FIG. 2. In this view, it may be appreciated that the coils 130 are connected to the top manifold 134 by tubes 132 and to a second manifold 138 through tubes 136. Referring to FIGS. 1 and 3, the tubes 132 connect to the interior flow paths 30 and tubes 138 communicate with the exterior flow paths 28 of the coils 130 of the heat exchanger 26. Thus, the top manifold 134 receives ground water from the pipe 94 as shown in FIG. 1. The tubes 136 communicate with the exterior flow path 28 so that the second manifold 138 is connected to pipe 32 as shown in FIG. 1.

Referring to the lower portion of the heat exchanger 26 of FIG. 3, there are shown tubes 140 that are interconnected between a third manifold 142 and the exterior flow path 30. Tubes 140 constitute the output of the exterior flow path 28 and, thus, the manifold 142 is connected to pipe 18. Tubes 144 are connected between the fourth manifold 146 and the other end of the interior flow path 30. Thus, manifold 146 is connected to pipe 96 for transmitting concrete water to the tanks 104 and 106.

The heat exchangers 26 and 58 operate most efficiently when the interior flow paths 30 and 62 are flowing in opposite directions from the exterior flow paths 28 and 60, respectively. Thus, the heat exchangers 26 and 58 may be designed to heat or cool cost efficiently by choosing the appropriate flow direction of the water and heat transfer fluid in the exchangers.

In the embodiment shown in FIG. 1, the heat transfer fluid in the heating mode flows in the opposite direction from the water from pipe 94. Thus, as shown in FIG. 1, the heat exchanger 26 is operating most efficiently in the heating mode. However, the heat exchanger 58 connected as shown in FIG. 1 operates in the heating mode with the heat transfer fluid and the water flowing in the same direction. Thus, heat exchanger 58 operates most efficiently in the cooling mode and less efficiently in the heating mode. Thus, heat exchangers 26 and 58 may be designed to operate most efficiently in either the heating or the cooling mode by adjusting the connections for the water or for the heat transfer fluid.

Although a particular embodiment of the invention has been described in the Detailed Description, it will be understood that the invention is capable of numerous rearrangements, modifications or substitutions of parts without departing from the spirit of the invention and there is no intention to limit the scope of the invention except as set forth in the following claims.

What is claimed is:

1. A concrete production apparatus for producing a concrete mix within a selected temperature range from cement, agggregate and concrete water oomprising:

a well drilled into the earth to a ground water table;

a pump for pumping ground water from said well for use in the concrete production apparatus;

heat exchange means for receiving and circulating ground water from said pump;

a water circulation system for circulating concrete water through said heat exchange means, said heat exchange means being operable to transfer heat between the concrete water and the ground water to temperature condition the concrete water to a predetermined temperature; and, means for mixing the concrete water at the predetermined temperature with the cement and aggregate to produce a concrete mix within the selected temperature range, the predetermined temperature of the concrete water being selected to bring the cement and aggregate temperature to within the selected temperature range.

2. A concrete production apparatus for producing a concrete mix within a selected temperature range from cement, aggregate and concrete water comprising:

a well drilled into the earth to a ground water table;

a first pump for pumping ground water from said well for use in the concrete production apparatus;

a first heat exchanger connected to receive and circulate ground water from said first pump through said first heat exchanger;

fluid circulation means interconnected with said first heat exchanger for circulating heat transfer fluid through said first heat exchanger so that heat may be transferred between the ground water and the heat transfer fluid;

a second heat exchanger interconnected with said fluid circulation means for receiving and circulating heat transfer fluid through said second heat exchanger;

a water circulation system for circulating water from said first pump through said first and second heat exchangers to exchange heat between the heat transfer fluid and the water in said heat exchangers and to temperature condition the water in said second heat exchanger to produce concrete water having a predetermined temperature; and means for mixing the concrete water at the predetermined temperature with cement and aggregate to produce the concrete mix within the selected temperature range, the predetermined temperature of the concrete water being selected to bring the concrete mix to within the selected temperature range.

3. The apparatus of claim 2 wherein said first and second heat exchangers each comprise a double-walled tubular coil having an interior flow path and an exterior flow path encompassing said interior flow path whereby fluids of differing temperatures that are circulated through said first and second flow paths will transfer heat therebetween.

4. The apparatus of claim 2 wherein said fluid circulation means comprises:

a compressor having an output and an input and being operable to produce pressurized fluid at its output and to receive at its input depressurized fluid relative to the pressurized fluid;

first compressor piping interconnecting the output of said compressor with at least one of said heat exchangers for transmitting pressurized fluid to said at least one of said heat exchangers;

an expansion valve system interconnecting said first and second heat exchangers for transmitting fluid therebetween and for expanding the pressurized fluid as said fluid flows from one heat exchanger to the other heat exchanger so that said other heat exchanger receives depressurized fluid relative to the pressure of the fluid in said one heat exchanger; and, second compressor piping interconnecting the input of said compressor with said other heat exchanger for transmitting the depressurized fluid from said other heat exchanger to the input of said compressor.

5. The apparatus of claim 4 wherein said expansion valve system comprises:

first and second expansion valves, each having an input and an output and being operable to expand fluid that flows through said expansion valves;

first and second input check valves having inputs, having outputs connected to the inputs of the first and second expansion valves, respectively, and being operable to allow fluid flow from the inputs to the outputs of the check valves and to check fluid flow from the outputs to the inputs thereof;

first and second output check valves having outputs, having inputs connected to the outputs of said first and second check valves, respectively, and being operable to allow fluid flow from the inputs to the outputs of the check valves and to check fluid flow from the outputs to the inputs thereof;

first and second exchanger piping interconnecting said first and second heat exchangers, respectively, with the inputs of the first and second output check valves, respectively; and, fluid circulation piping interconnecting the outputs of said first and second output check valves and the inputs of said first and second input check valves, whereby when pressurized fluid is present in said first exchanger piping, it flows through said first output check valve, through said circulation piping, through said second input check valve, through said second expansion valve where the fluid is expanded, and through said second exchanger piping to said second heat exchanger; and when pressurized fluid is present in said second exchanger piping, it flows through said second output check valve, through said circulation piping, through said first check valve, through said first expansion valve where the fluid is expanded, and through said first exchanger piping to said first heat exchanger.

6. The apparatus of claim 5 wherein said first and second compressor piping comprises:

a four-way valve having first, second, third and fourth input/output ports and being switchable between a first position interconnecting the first and second ports and the third and fourth ports and a second position interconnecting the first and fourth ports and the second and third ports;

a first pipe connected between the output of said compressor and the first port of said four-way valve;

a second pipe connected between the second port of said four-way valve and said first heat exchanger;

a third pipe for connecting the third port of said four-way valve and the input of said compressor;

a fourth pipe connected between the fourth port of said four-way valve and said second heat exchanger, whereby said four-way valve is operable in the first position to transmit pressurized fluid from said compressor to said first heat exchanger and transmit depressurized fluid, relative to the pressurized fluid, from said second heat exchanger to said compressor; and said four-way valve is operable in the second position to transmit pressurized fluid from said compressor to said second heat exchanger and transmit depressurized fluid from said first heat exchanger to said compressor.

7. The apparatus of claim 6 wherein said first and second expansion valves each further comprise:

heat and pressure sensor means for monitoring the temperature and pressure of the fluid in said third pipe; and, means responsive to said heat and pressure sensor means to vary the expansion characteristics of said expansion valve.

8. The apparatus of claim 6 further comprising a receiving tank for receiving and holding fluid from said third pipe, said fluid circulation piping being at least partially disposed in said receiving tank so that the fluid in said receiving tank is heated by the fluid flowing in said circulation piping toward one of said expansion valves.

9. The apparatus of claim 2 wherein said water circulation system comprises:

ground water piping connected to said first pump for transmitting ground water to said second heat exchanger;

means for discharging ground water from said second heat exchanger;

second ground water piping connected to said first pump for transmitting ground water to said first heat exchanger for being temperature conditioned to produce concrete water;

first concrete water piping for transmitting concrete water from said first heat exchanger;

at least one storage tank for receiving and holding concrete water; and, means for recirculating concrete water from said storage tank back through said first heat exchanger.

10. The apparatus of claim 2 wherein said water circulation system comprises:

first ground water piping connected to said first pump for transmitting ground water to said second heat exchanger;

means for discharging ground water from said second heat exchanger;

an on/off valve;

second ground water piping for transmitting ground water from said pump to said on/off valve;

third ground water piping connected to transmit ground water from said on/off valve to said first heat exchanger for being temperature conditioned within said first heat exchanger to produce concrete water;

first concrete water piping for transmitting concrete water from said first heat exchanger;

at least one storage tank for receiving and holding concrete water;

first tank valve means for selectively transmitting concrete water from said first concrete water piping to said at least one tank;

second tank valve means for selectively transmitting concrete water from said at least one tank;

a second pump for pumping concrete water from said at least one tanks through said second tank valve means;

a return pipe connected to transmit concrete water to said third ground water piping;

means for mixing concrete water into cement and aggregate; and third tank valve means for selectively transmitting concrete water to said return pipe and to said means for mixing concrete water, whereby concrete water from said tanks may be mixed with cement and aggregate or recirculated through said first heat exchanger.

* * * * *